US005738759A

United States Patent [19]

Kitazawa et al.

[11] Patent Number: 5,738,759

[45] Date of Patent: Apr. 14, 1998

[54] RECORDING MATERIAL, METHOD OF PRODUCING THE SAME AND METHOD OF RECYCLING RECORDING MATERIAL

[75] Inventors: Hiroshi Kitazawa; Shigeaki Kimura, both of Mishima; Eiichi Kawamura, Numazu; Toshiyuki Kawanishi, Numazu; Masato Igarashi, Numazu, all of Japan

[73] Assignee: Ricoh Company, Ltd., Tokyo, Japan

[21] Appl. No.: 538,209

[22] Filed: Oct. 2, 1995

Related U.S. Application Data

[60] Continuation-in-part of Ser. No. 457,513, Jun. 1, 1995, abandoned, which is a division of Ser. No. 293,323, Aug. 22, 1994, Pat. No. 5,607,534.

[30] Foreign Application Priority Data

| | | | |
|---|---|---|---|
| Aug. 20, 1993 | [JP] | Japan | 5-228187 |
| Sep. 30, 1993 | [JP] | Japan | 5-244633 |
| Sep. 30, 1993 | [JP] | Japan | 5-244634 |
| Oct. 1, 1993 | [JP] | Japan | 5-247051 |
| Oct. 14, 1993 | [JP] | Japan | 5-256905 |
| Oct. 14, 1993 | [JP] | Japan | 5-280524 |
| Oct. 26, 1993 | [JP] | Japan | 5-267472 |
| Feb. 28, 1994 | [JP] | Japan | 6-054534 |
| Sep. 30, 1994 | [JP] | Japan | 6-237944 |

[51] Int. Cl.[6] ..... D21H 19/10

[52] U.S. Cl. ..... 162/135; 162/158; 162/164.1; 162/164.3; 162/164.6; 162/166; 162/168.1; 162/168.2; 162/168.3; 162/175; 162/183; 162/185

[58] Field of Search ..... 162/135, 158, 162/164.1, 164.3, 164.6, 168.1, 168.2, 168.3, 181.1, 183, 185, 165, 166, 167, 175; 427/391, 395

[56] References Cited

U.S. PATENT DOCUMENTS

| | | | |
|---|---|---|---|
| 3,058,873 | 10/1962 | Keim et al. | 162/164.3 |
| 4,442,172 | 4/1984 | Oshima et al. | 162/135 |
| 5,126,010 | 6/1992 | Kobayashi et al. | 162/158 |
| 5,270,103 | 12/1993 | Oliver et al. | 162/135 |
| 5,403,445 | 4/1995 | Shimomura et al. | 162/158 |
| 5,541,002 | 7/1996 | Hosoi et al. | 162/135 |

FOREIGN PATENT DOCUMENTS

| | | | |
|---|---|---|---|
| 55-103396 | 8/1980 | Japan | 162/135 |

*Primary Examiner*—Peter Chin
*Attorney, Agent, or Firm*—Oblon, Spivak, McClelland, Maier & Neustadt, P.C.

[57] ABSTRACT

A recording material including paper containing cellulose fibers as the main component, with the elongation percentage of the paper in the cross direction thereof when immersed in water at 20° C. for 1 minute being 1.8 % or less, is produced and recycled. In addition, paper containing cellulose fibers, with the same elongation percentage as mentioned above in the machine direction thereof is also provided.

33 Claims, No Drawings

RECORDING MATERIAL, METHOD OF PRODUCING THE SAME AND METHOD OF RECYCLING RECORDING MATERIAL

This application is a continuation-in-part of application Ser. No. 08/457,513, filed Jun. 1, 1995 abandoned, which is a divisional application of Ser. No. 08/293,323, filed Aug. 22, 1994 now U.S. Pat. No. 5,607,534.

BACKGROUND OF THE INVENTION

1. Field of the Invention

The present invention relates to a recording material which comprises paper comprising cellulose fibers, capable of bearing images thereon which are copied or recorded by use of a thermofusible or thermosoftening ink, particularly to a recording material which can be recycled repeatedly from an image-bearing recording material with removal of images formed by a thermofusible or thermosoftening ink therefrom. The present invention also relates to a method of producing the recording material.

The present invention also relates to a method of recycling such a recording material by removing the images therefrom.

The present invention further relates to a paper with excellent dimensional stability that can be used as the above-mentioned recyclable recording material.

2. Discussion of Background

In accordance with recent operational speed-up of copying machines and printers, there is a keen demand for copy paper and recording paper which are free from the problems of the formation of wrinkles and the occurrence of jamming as caused by the changes in the ambient humidity or by application of heat thereto.

Furthermore, because of recent rapid development of office automation, a large quantity of paper is used and consumed for printers and copying machines, so that considerable deforestation is being carried out, causing many problems with respect to the environmental disruption of the earth.

As a countermeasure against the problem of the environmental disruption of the earth due to deforestation, conventionally, papers have been recycled by removing printed ink from used papers to obtain ink-free paper, pulping the ink-free paper and making paper therefrom so that they can be used again.

However, recently there has been developed a method for recycling used copy papers by merely cleaning printed images off the surface of the copy papers so that they can be successively used for making copies or recording.

Examples of such a recycling method have been described, for instance, in the following references:

(1) Japanese Laid-Open Patent Application 4-67043:

In this reference, there is proposed a sheet-shaped recording material with one surface side thereof being treated so as to be made image-releasable with application of a releasing agent, so that images can be formed on the support material and released therefrom repeatedly. In this recording material, a special mark is placed in order to distinguish it from ordinary plain paper.

This recording material, however, has the following drawbacks:

(a) Since this recording material is a special surface-treated copy sheet, it cannot be used in the same manner as conventional copy papers and printing papers which are currently used in a large quantity.

(b) Therefore, it is difficult to use this surface-treated copy sheet by being mixed with conventional copy papers in general use.

(c) In view of the significance of recycling resources, duplex copies which bear images on both sides thereof are useful and will be used mainly in the future. Under such circumstances, however, there will be difficulties in recycling copy papers with a releasing agent being applied to one side thereof.

(2) Japanese Laid-Open Patent Applications 1-101576 and 1-101577:

In these references, there are proposed methods of recycling recording materials which bear toner images thereon. Namely, in these methods, a toner-image-bearing recording material is immersed into an organic solvent in which a resin contained in the toner images is soluble, and is then subjected to ultrasonic wave treatment, thereby removing toner images from the recording material. These methods, however, have the shortcomings that the organic solvents used in these methods cause air pollution problems and are ignitable and toxic, accordingly not suitable for office or home use.

(3) Japanese Laid-Open Patent Application 1-297294:

In this reference, there is disclosed a recording method in which there is used a recording material made of plastics, metals, papers into which liquids hardly penetrate, or ceramics materials, which is in the form of an erasable sheet with an image-bearing-surface side thereof being treated so as to be image-erasable.

Images formed on such a recording material can be peeled away from the recording material by heating the images through a thermofusible image releasing member, whereby the surface of the recording material can be cleaned. In this method, however, the above-mentioned special image-erasable recording material must be used. Copy papers and printing papers now in general use in a large quantity cannot be used in this method.

Furthermore, a method of recycling recording materials has recently been proposed, in which a water-containing image removal acceleration liquid is applied to an image-bearing recording material, and images are caused to adhere to an image releasing member, whereby images are peeled away from the image-bearing recording material. This is an effective recycling method since images can be securely peeled away from the recording material. However, in this method, the water-containing image liquid which wets the paper portion of a recording material is used. Therefore, when this method is applied to conventionally employed copy paper sheets comprising as the main component cellulose fibers, the following problems are caused:

(1) Wrinkles are formed in the copy paper sheets when passed in the machine direction thereof through a recycling apparatus using the above-mentioned method.

(2) Wrinkles are formed in recycled copy paper sheets when copies are made by use of the recycled copy paper sheets.

SUMMARY OF THE INVENTION

It is therefore a first object of the present invention to provide a recording material which comprises paper comprising cellulose fibers as the main component, free from the formation of wrinkles therein and the occurrence of jamming by the moisture and heat when used as a copy sheet in copying machines, and also free from the above problems when the recording material is recycled from an image-bearing recording material with the application thereto of water or an aqueous solution comprising a surfactant and/or a water-soluble polymer, which may be referred to as "image removal acceleration liquid" to peel images away from the recording material, with an image peeling member being brought into contact with the images under application of heat and/or pressure.

A second object of the present invention is to provide a method of producing the above recyclable recording material.

A third object of the present invention is to provide a method of recycling the recording material by removing images from an image-bearing recyclable recording material.

A fourth object of the present invention is to provide a paper with excellent dimensional stability that can be used as the above-mentioned recyclable recording material.

The first object of the present invention can be achieved by a recording material comprising paper which comprises cellulose fibers, wherein the elongation percentage of the paper in the cross direction thereof when immersed in water at 20° C. for 1 minute is 1.8% or less. This elongation percentage may be referred to as the wet elongation percentage.

The second object of the present invention can be achieved by a method of producing a recyclable recording material comprising paper which comprises cellulose fibers and a single or combined component selected from the group consisting of (a) a water-proofing agent, (b) a water-proofing agent and a water-soluble polymer, (c) a water-proofing agent and a sizing agent, and (d) a water-proofing agent, a water-soluble polymer and a sizing agent, which forms a protection structure for binding the cellulose fibers, with the elongation percentage of the paper in the cross direction thereof when immersed in water at 20° C. for 1 minute being 1.8% or less, by use of a pulp which comprises a water-proofing agent in an amount of 0.4 wt. % or more, and a water-soluble polymer in amount of 3 wt. % or more or a sizing agent in an amount of 0.4 wt. % or more, with respect to the entire weight of the pulp.

The third object of the present invention is achieved by a method of recycling a recording material comprising paper which comprises cellulose fibers and one component or component combination selected from the group consisting of (a) a water-proofing agent, (b) a water-proofing agent and a water-soluble polymer, (c) a water-proofing agent and a sizing agent, and (d) a water-proofing agent, a water-soluble polymer and a sizing agent, the recording material bearing images made of a thermofusible ink or thermosoftening ink on the surface thereof, comprising the steps of: (1) causing the recording material to hold an aqueous liquid comprising an image removal acceleration liquid on the surface thereof, and (2) peeling the images away from the surface of the recording material by use of an image peeling member which is caused to adhere to the images under the application of heat or pressure thereto.

The fourth object of the present invention is achieved by a paper comprising cellulose fibers, wherein the elongation percentage of the paper in the machine direction thereof when immersed in water at 20° C. for 1 minute is 1.8% or less; the Bristow penetration rate thereof, which is measured by wetting the paper with a wetting liquid comprising a surfactant, is in a range of 12 to 60 ml/m$^2$ per a period of 0.4 seconds; and the wetting-agent treated pen-writing sizing degree thereof, which is measured by immersing the paper in a wetting liquid comprising a surfactant for 5 seconds and then drying the paper at 110° C., is in Rank 5 to 9.

DESCRIPTION OF THE PREFERRED EMBODIMENTS

The recording material of the present invention comprises paper which comprises cellulose fibers as the main component, wherein the elongation percentage of the paper in the cross direction thereof when immersed in water at 20° C. for 1 minute is 1.8% or less.

The above recording material of the present invention is capable of preventing the formation of wrinkles in the recording material and the occurrence of jamming thereof, which are caused by the moisture and heat when used as a copy sheet in copying machines, and also capable of preventing the above problems when the recording material is recycled from an image-bearing recording material by applying a water-containing image removal acceleration liquid to the image-bearing recording material, and peeling images away from the recording material by causing an image peeling member to adhere to the images under application of heat and/or pressure. In particular, there can be prevented the formation of wrinkles in the recording material when passed in the machine direction thereof through a recycling apparatus using the above-mentioned method; and the formation of wrinkles in the recycled recording material when copies are made by use of the recycled recording material.

The inventors of the present invention investigated the mechanism of the formation of wrinkles in the recording material when recycled from an image-bearing recording material, which is referred to as "machine-direction passing wrinkles", and also the mechanism of the formation of wrinkles in the recording material when copies are made from the recycled recording material by use of a copying machine or the like, which is referred to as "re-copying wrinkles".

The result was that when the recording material which comprises paper comprising as the main component cellulose fibers is wet with water or with the water-containing image removal acceleration liquid, the cellulose fibers of the paper swell, so that the binding force between the cellulose fibers is decreased and the paper structure slackens and loosens.

The inventors of the present invention have discovered that in order to prevent the paper structure from slackening or loosening, it is essential to form a protection structure for protecting the bonding points of the cellulose fibers against water; that the protection structure can be formed by (1) hardening the bonding points with a water-proofing agent, (2) covering or wrapping the bonding points with a water-soluble polymer or (3) subjecting the surface of the paper to strong sizing; and that the formation of the above-mentioned "machine-direction passing wrinkles" and "re-copying wrinkles" can be prevented by the formation of the above-mentioned protection structure.

In the recording material of the present invention, when the elongation percentage of the paper in the cross direction thereof when immersed in water at 20° C. for 1 minute is set at 1.8% or less by the formation of the above-mentioned protection structure, the formation of the above-mentioned "machine-direction passing wrinkles" and "re-copying wrinkles" can be effectively prevented.

More specifically, in the present invention, it is preferable that any of (a) a water-proofing agent, (b) a water-proofing agent and a water-soluble polymer, (c) a water-proofing agent and a sizing agent, or (d) a water-proofing agent, a water-soluble polymer and a sizing agent be contained for forming the protection structure for binding the cellulose fibers.

In the present invention, the above-mentioned protection structure can be formed by use of a water-proofing agent alone as mentioned above. However, a relatively large amount of a water-proofing agent is required for the formation of the protection structure. In case a water-proofing agent is used excessively, the images releasability of the recording material becomes insufficient and the paper-like property of the recording material is lost.

In case only a water-soluble polymer is used, the stiffness of the recording material is significantly increased and therefore the formation of "re-copying wrinkles" can be effectively prevented, but the formation of "machine-direction passing wrinkles" cannot be effectively prevented when the recycling is repeated more than two times.

The sizing agent is effective for controlling the penetration of water or the previously mentioned water-containing image removal acceleration liquid into the recording material.

When the water-proofing agent is contained alone, it is preferable that the amount thereof be 0.3 wt. % or more with respect to the entire weight of the paper.

When the water-proofing agent and the water-soluble polymer are contained in combination, or when the water-proofing agent and the sizing agent are contained in combination, it is preferable that the amount of the water-proofing agent be 0.3 wt. % or more, more preferably in the range of 0.5 to 1 wt. %, the amount of the water-soluble polymer be 2 wt. % or more, more preferably in the range of 2 to 5 wt. %, and the amount of the sizing agent be 0.3 wt. % or more, more preferably in the range of 0.5 to 1.2 wt. %, with respect to the entire weight of the paper.

When the water-proofing agent, the water-soluble polymer and the sizing agent are all contained in combination, it is preferable that the amount of the water-proofing agent be 0.3 wt. % or more, more preferably in the range of 0.5 to 1.0 wt. %, the amount of the water-soluble polymer be 2 wt. % or more, more preferably in the range of 2 to 5 wt. %, and the amount of the sizing agent be 0.3 wt. % or more, more preferably in the range of 0.5 to 1.2 wt. % with respect to the entire weight of the paper.

When the water-proofing agent, the water-soluble polymer and the sizing agent are contained in combination, it is most effective for the prevention of the formation of the above-mentioned "machine-direction passing wrinkles" and "re-copying wrinkles", the occurrence of jamming of the recording material in copying machine, and the spreading of images and characters written thereon with an aqueous ink pen and images stamped with an aqueous ink; for improvement of the image releasability of the recording material, and for imparting paper-like property to the recording material.

In order to produce the above-mentioned recording material of the present invention which comprises paper comprising cellulose fibers and a single or combined component selected from the group consisting of (a) a water-proofing agent, (b) a water-proofing agent and a water-soluble polymer, (c) a water-proofing agent and a sizing agent, and (d) a water-proofing agent, a water-soluble polymer and a sizing agent, which forms a protection structure for binding the cellulose fibers, with the elongation percentage of the paper in the cross direction thereof when immersed in water at 20° C. for 1 minute being 1.8% or less, by use of a pulp, it is preferable that the pulp comprise a water-proofing agent in an amount of 0.4 wt. % or more, more preferably in an amount of 0.6 to 1.2 wt. %, and a water-soluble polymer in amount of 3 wt. % or more, more preferably in an amount of 3 to 6 wt. %, and a sizing agent in an amount of 0.4 wt. % or more, more preferably in an amount of 0.6 to 1.6 wt. %, with respect to the entire weight of the pulp.

Furthermore, it is also preferable that a mixture of about 10 to 40 parts by weight of a water-proofing agent and 100 parts by weight of a water-soluble polymer be employed in the paper of the recording material of the present invention, with the surface of the recording material being subjected to strong sizing for controlling the penetration of water into the recording material.

In the present invention, the water-proofing agent, the water-soluble polymer and the sizing agent may be internally added to the paper of the recording material. However, it is preferably that at least one component or part of the water-proofing agent, the water-soluble polymer or the sizing agent be externally added thereto by surface sizing.

It is preferable that the ratio of the amount of such components added externally by surface sizing to the amount thereof added internally be 1 or more.

Such surface sizing can be most preferably performed by size press apparatus. An on-machine gate roll coater and Bill blade coater can also be employed for such surface sizing. Coaters for use in the present invention may also be off-machine coaters.

In the recording material of the present invention which comprises paper comprising as the main component cellulose fibers, wherein the elongation percentage of the paper in the cross direction thereof when immersed in water at 20° C. for 1 minute is 1.8% or less, it is preferable that the paper have Rank 5 or more, more preferably Rank 5 to 9, with respect to the wetting-agent treated pen-writing sizing degree thereof, which is measured by immersing the paper in a wetting liquid comprising a surfactant for 5 seconds and then drying the paper at 110° C., in order to more effectively prevent the formation of "machine-direction passing wrinkles" and "re-copying wrinkles", and the spreading of images and characters written thereon with an aqueous ink pen and images stamped with an aqueous ink.

Further, in order to improve the image releasing property of the recording material, to impart the paper-like property to the recording material, and to prevent the formation of the above-mentioned "machine-direction passing wrinkles" and "re-copying wrinkles", and the occurrence of jamming of the recording material in copying machine furthermore, it is preferable that the paper of the recording material of the present invention have at least one of the following characteristics, in addition to the previously mentioned wet elongation percentage of 1.8% or less:

(1) The ratio of the wet tensile strength of the paper to the non-wet tensile strength of the paper in the machine direction thereof is 0.16 or more, more preferably in the range of 0.16 to 0.4, when the wet tensile strength thereof is determined after wetting the paper by immersing the paper in water at 20° C. for 1 minute, and the non-wet tensile strength thereof is determined prior to the wetting.

(2) The Bristow penetration rate of the paper is in the range of 12 to 60 ml/m$^2$ per a period of 0.4 seconds, which is measured by wetting the paper with a wetting liquid comprising a surfactant for 0.4 seconds.

(3) The wetting-agent treated sizing degree of the paper is 0.3 s or more, more preferably in the range of 0.3 s to 3 s, which is measured by immersing the paper in a wetting liquid comprising a surfactant for 5 seconds and then drying the paper at 110° C.

(4) The wet stiffness thereof in the machine direction of the paper is 0.3 mN or more, which is measured by immersing the paper in water at 20° C. for 1 minute, in accordance with the Gurley method.

(5) The short-time wetting elongation percentage of the paper in the cross direction thereof is 1.0% or less, which is measured by bringing the paper into contact with a wetting liquid comprising a surfactant for 3 seconds.

The above-mentioned characteristics (4) and (5) are particularly important for preventing the formation of "machine-direction passing wrinkles" and "re-copying wrinkles".

The above-mentioned characteristics are determined by the following measurement methods:

[Wet elongation percentage]

An A4 size recording paper sheet is immersed in water at 20° C. for 1 minute, and excessive water is removed by use of a filter from the recording paper sheet, and the elongation of the thus wet recording paper sheet is measured by use of a first grade Japanese Industrial Standards (JIS) metal scale and the elongation percentage of the thus wet recording paper sheet in the cross direction thereof is calculated in comparison with the corresponding original size prior to the wetting. This elongation percentage is referred to as the wet elongation percentage.

[wetting-agent treated pen-writing sizing degree]

The recording paper sheet to be tested is immersed in a commercially available 0.8% aqueous solution of an anionic surfactant, sodium dihexylsulfosuccinate, (Trademark "MA-80" made by Mitsui Cytec, Ltd.) for 5 seconds, and immediately wiping up the excessive aqueous solution from the recording paper sheet by use of a filter paper, drying the recording paper sheet at 110° C. in a drum dryer for 2 minutes, adjusting the moisture of the recording paper sheet to 65%RH at 20° C.

On the thus treated recording paper sheet, line images and English letter images are formed by use of a blue ink and an ink pen with a diameter of 0.5 mm (made by The Pilot Corporation) by use of a commercially available plotter ("MP4200" made by GRAPH TEC Co., Ltd.) with a pen speed of 50 cm/s, and the spreading of written line images and English characters is evaluated with reference to ink spreading samples with the following 10 Ranks, whereby the wetting-agent treated pen-writing sizing degree is determined:

Rank 10: Lines and letters appear conspicuously scratchy with the ink being slightly repelled from the recording paper sheet.

Rank 9: Letters appear scratchy and thin.

Rank 8: Letters appear neither scratchy nor thin. There is no ink spreading and the contours of letters are kept in good shape.

Rank 7: Letters partly appear thick with some ink spreading and darker in the color, for instance, in the curved and end portions of letters.

Rank 6: The thickness and color depth of letters are almost the same as those of the letters in Rank 7, but some ink spreading is recognized in the letters.

Rank 5: Letters appear thick and dark in the color as a whole, although lighter portions are partly included therein.

Rank 4: The thickness and color depth of letters are almost the same as those of the letters in Rank 5, but ink spreading is conspicuously recognized in the letters.

Rank 3: Letters appear dark in the color as a whole and also thick.

Rank 2: The thickness and color depth of letters are almost the same as those of the letters in Rank 3, but ink spreading is conspicuously recognized in the letters.

Rank 1: Letters appear thick and defaced.

[Non-wet tensile strength]

The non-wet tensile strength of the A4 size recording paper sheet in the machine direction thereof is measured in accordance with the Japanese industrial Standards (JIS) P8113.

[Wet tensile strength]

The above recording paper sheet is then immersed in water at 20° C. for 1 minute, and excessive water is wiped off from the surface of the recording paper sheet. The tensile strength of the thus wet recording paper sheet in the machine direction thereof, which is referred to as the wet tensile strength in the machine direction, is then measured in accordance with the Japanese Industrial Standards (JIS) P8135.

[Ratio of wet tensile strength to non-wet tensile strength]

The ratio of the wet tensile strength to the non-wet tensile strength is calculated by dividing the wet tensile strength by the non-wet tensile strength.

[Bristow penetration rate]

A 0.8% aqueous solution of the previously mentioned surfactant "MA-80" is applied to this recording paper sheet, and the amount (ml/m$^2$) of the aqueous solution penetrated for 0.4 seconds is measured in accordance with the Bristow Method (JAPAN TAPPI Paper Pulp Test Method No. 51), whereby the wetting liquid penetration rate of this recording paper sheet is calculated, which is referred to as the Bristow penetration rate.

[Wetting-agent treated sizing degree]

The recording paper sheet to be tested is immersed in a 0.8% aqueous solution of the previously mentioned commercially available surfactant "MA-80" for 5 seconds, and wiping up the excessive aqueous solution from the recording paper sheet by use of a filter paper, drying the recording paper sheet at 110° C. in a drum dryer for 2 minutes, adjusting the moisture of the recording paper sheet to 65% RH at 20° C.

The thus moisture-adjusted recording paper sheet is then caused to float on a 2% aqueous solution of ammonium thiocyanate, and the time period required for the recording paper sheet to become transparent in its entirety by the penetration of the ammonium thiocyanate solution into the recording paper sheet is measured, whereby the wetting-agent treated sizing degree of the recording paper sheet is determined in terms of the time period with a unit of second.

[Wet stiffness]

The stiffness of the recording paper sheet is measured by immersing the recording paper sheet in water at 20° C. for 1 minute, and then wiping off excessive water the surface of the recording paper sheet, and subjecting the recording paper sheet to the Gurley method by use of a Gurley tester.

[Short-time wet elongation percentage]

A tension of 350 mN is applied to the recording paper sheet to be tested, and a 0.8% aqueous solution of the previously mentioned commercially available surfactant "MA-80" is then applied thereto for 3 seconds, and the elongation percentage of this recording paper sheet in the cross direction thereof is measured. This elongation percentage is referred to as the short-time wet elongation percentage.

Preferable examples of a water-proofing agent for use in the present invention are polyamide-epichloro-hydrin resin, glyoxal and melamine-formaldehyde resin. Water-proofing agents for use in paper, such as urea-formaldehyde resin and polyethyleneimene resin, may also be employed as long as the amount thereof to be added is appropriately adjusted.

Preferable examples of a water-soluble polymer for use in the present invention are polyvinyl alcohol (PVA), starch and polyacrylamide resin, since they are most effective and easiest to use. Plant gum, sodium alginate, carboxymethyl cellulose, methyl cellulose, chitosan, glue, casein, polyvinyl acetate and latex may also be employed as long as the amount thereof to be added is appropriately adjusted.

As a sizing agent for use in the present invention, it is preferable to use a sizing agent comprising a sizing agent component having a contact angle (cosθ) in a range of −0.6 to 0.9 when a liquid with a surface tension of 40 mN/m is placed dropwise on a film prepared by drying the sizing agent component. In this sense, an alkyl ketene dimer sizing agent is preferable for use in the present invention. Synthetic sizing agents such as styrene sizing agent and olefin sizing agent can also be employed in the present invention.

Examples of commercially available sizing agents that can be employed in the present invention are "POLYMARON 360", "POLYMARON 356", "POLYMARON 482" and "POLYMARON 1301" (Trademark), made by Arakawa Chemical Industries, Ltd.; "SA-802", "SA-501", "SA-502" and "SA-708" (Trademark), made by Sanyo Chemical Industries, Ltd., "Pearlgum CS", "Colopearl M" and "Colopearl S" (Trademark), made by Seiko Chemical Industries Co., Ltd.; "Hama Coat S, X" (Trademark), made by Hamano Kogyo Co., Ltd.; "HARSIZE CP, KN" (Trademark), made by Harima Kasei Kogyo Co., Ltd.; and "AK" (Trademark), made by MISAWA CERAMIC CHEMICAL CO., LTD.

The present invention further provides a method of recycling a recording material comprising paper which comprises cellulose fibers and one component or component combination selected from the group consisting of (a) a water-proofing agent, (b) a water-proofing agent and a water-soluble polymer, (c) a water-proofing agent and a sizing agent, and (d) a water-proofing agent, a water-soluble polymer and a sizing agent, which recording material bears images made of a thermofusible ink or thermosoftening ink on the surface thereof, comprising the steps of: causing the recording material to hold a water-containing image removal acceleration liquid on the surface thereof, and peeling the images away from the surface of the recording material by use of an image peeling member which is caused to adhere to the images under the application of heat or pressure thereto.

Each of the above-mentioned (a) water-proofing agent, (b) water-proofing agent and water-soluble polymer, (c) water-proofing agent and sizing agent, and (d) water-proofing agent, water-soluble polymer and sizing agent, serves as a wet paper strength reinforcement agent, and as such a wet paper strength reinforcement agent, the previously mentioned water-proof agent can be used alone, and the previously mentioned water-proof agent, water-soluble polymer, and sizing agent can also be employed in any of the above-mentioned combinations.

Of the above-mentioned combinations (a) to (d), the combination (d) is most preferable.

The respective amounts of the water-proofing agent, water-soluble polymer and sizing agent are the same as those described previously in the recording material of the present invention.

It is preferable that the wet elongation percentage of the paper in the machine direction thereof for the recording material for use in the recycling method of the present invention when immersed in water at 20° C. for 1 minute be 1.8% or less.

According to the recycling method of the present invention, the formation of the previously mentioned "machine-direction passing wrinkles" and "re-copying wrinkles" can be effectively prevented by use of the paper for the recording material.

Further, in order to improve the image releasing property of the recording material, to impart the paper-like property to the recording material, and to prevent the formation of the above-mentioned "machine-direction passing wrinkles" and "re-copying wrinkles", and the occurrence of Jamming of the recording material in copying machine, it is preferable that the paper of the recording material for use in the recycling method of the present invention have at least one of the following characteristics in addition of the above-mentioned wet elongation percentage of 1.8% or less:

(1) The wetting-agent treated pen-writing sizing degree of the paper, which is measured by immersing the paper in a wetting liquid comprising a surfactant for 5 seconds and then drying the paper at 110° C., is in the previously mentioned Rank 5 to 9.

(2) The ratio of the wet tensile strength of the paper to the non-wet tensile strength of the paper in the machine direction thereof is 0.16 or more, more preferably in the range of 0.16 to 0.4, when the wet tensile strength thereof is determined after wetting the paper by immersing the paper in water at 20° C. for 1 minute, and the non-wet tensile strength thereof is determined prior to the wetting.

(3) The Bristow penetration rate of the paper is in the range of 12 to 60 ml/m$^2$ per a period of 0.4 seconds, which is measured by wetting the paper with a wetting liquid comprising a surfactant for 0.4 seconds.

(4) The wetting-agent treated sizing degree of the paper is 0.3 s or more, more preferably in the range of 0.3 s to 3 s, which is measured by immersing the paper in a wetting liquid comprising a surfactant for 5 seconds and then drying the paper at 110° C.

(5) The wet stiffness thereof in the machine direction of the paper is 0.3 mN or more, which is measured by immersing the paper in water at 20° C. for 1 minute, in accordance with the Gurley method.

(6) The short-time wetting elongation percentage of the paper in the cross direction thereof is 1.0% or less, which is measured by bringing the paper into contact with a wetting liquid comprising a surfactant for 3 seconds.

It is more preferable that the paper for the recording material for use in the recycling method of the present invention have all of the above characteristics at the same time.

It is preferable that the ratio of the wet tensile strength of the paper for the recording material for use in the recycling method of the present invention to the non-wet tensile strength thereof in the machine direction thereof be in the range of 0.16 to 0.4, and the wetting-agent treated pen-writing sizing degree thereof be in the range of 0.3 s to 3 s.

It is preferable that each of the above-mentioned (a) water-proofing agent, (b) water-proofing agent and water-soluble polymer, (c) water-proofing agent and sizing agent, and (d) water-proofing agent, water-soluble polymer and sizing agent for use in the paper for the recording material for use in the recycling method of the present invention form a protection structure for binding the cellulose fibers contained in the paper.

It is preferable that the paper for the recording material for use in the recycling method of the present invention comprise the water-proofing agent in an amount of 0.3 wt. % or more, more preferably 0.5 to 1 wt. %, and the water-soluble polymer in an amount of, 2 wt. % or more, more preferably 2 to 5 wt. % in combination with respect to the entire weight of the paper, or the water-proofing agent in an amount of, 0.3 wt. % or more, more preferably 0.5 to 1 wt. % and the sizing agent in an amount of 0.3 wt. % or more, more preferably 0.5 to 1.2 wt. % in combination with respect to the entire weight of the paper; or all of the water-proofing agent, the water-soluble polymer and the sizing agent in the above-mentioned respective amounts.

It is preferable that the water-proofing agent for use in the paper of the recording material for use in the recycling method of the present invention be selected from the group consisting of polyamide epichlorohydrin resin, glyoxal and melamine-formaldehyde resin.

It is preferable that the water-soluble polymer for use in the paper of the recording material for use in the recycling method of the present invention be selected from the group consisting of polyvinyl alcohol, starch and polyacrylamide resin.

It is preferable that the sizing agent for use in the paper of the recording material for use in the recycling method of the present invention comprise a sizing agent component having a contact angle ($\cos\theta$) in a range of −0.6 to 0.9 when a liquid with a surface tension of 40 mN/m is placed dropwise on a film prepared by drying the sizing agent component.

Images can be formed on the recording material of the present invention by use of a thermofusible or thermosoftening ink by electrophotography, thermal transfer or ink jet printing.

Preferable examples of the image removal acceleration liquid for use in the present invention are water, an aqueous solution containing a surfactant, an aqueous solution containing a water-soluble polymer, an aqueous solution containing a surfactant and a water-soluble polymer.

By the use of a surfactant, the water-containing image removal acceleration liquid can be surely and speedily caused to penetrate into the contact portions between the cellulose fibers of the recording material and hydrophobic images formed thereon, whereby the hydrophobic images can be speedily peeled away from the surface of the recording material.

Examples of the above-mentioned surfactant for use in the present invention are Conventional surfactants and fluorine-based surfactants. Specific examples of such conventional surfactants include anionic surfactants such as carboxylic acid salt, sulfonic acid salt, sulfuric ester salt, phosphoric ester salt, and phosphonic acid salt; Cationic surfactants such as amine salt, quaternary ammonium salt, benzalkonium salt, benzethonium chloride salt, pyridinium salt, imidazolinium salt, sulfonium salt, polyethylene polyamine; ampholytic surfactants such as amino acid, carboxybetaine, sulfobetaine, aminosulfuric ester, aminocarboxylic acid salt, and imidazoline derivative; and nonionic surfactants such as ether type, ether ester type, ester type and nitrogen-containing type surfactants, polyhydric alcohol, amino alcohol, and polyethylene glycol.

It is preferable that the concentration of any of the above surfactants in the aqueous solution thereof be in the range of 0.01 to 20 wt. %, more preferably in the range of 0.01 to about 5 wt. %.

Examples of the above-mentioned water-soluble polymer are natural polymers, for example, starches such as sugar cane starch, potato starch, tapioca starch, wheat starch and corn starch, mannan such as konnyaku, marine algae such as glue plant, agar and sodium alginateor, plant mucilage such as hibiscus, tragacanth gum and gum arabic, microorganism mucilage such as dextran and levan, and protein such as glue, gelatin, casein and collagen; cellulose-based semisynthetic or synthetic polymers such as viscose, methyl cellulose, ethyl cellulose, hydroxyethyl cellulose, carboxymethyl cellulose; and starch-based semisynthetic or synthetic polymers such as soluble starches, carboxymethyl starch and dialdehyde starch.

The image releasing member for use in the present invention may be made of a variety of polymers, rubber and metals such as aluminum and nickel, in the form of a sheet, a belt or a roller, or in any other forms so as to be supported on the surface of a support member.

The present invention also provides a paper comprising cellulose fibers, wherein the elongation percentage of the paper in the machine direction thereof when immersed in water at 20° C. for 1 minute is 1.8% or less; the Bristow penetration rate thereof, which is measured by wetting the paper with a wetting liquid comprising a surfactant, is in a range of 12 to 60 ml/m$^2$ per a period of 0.4 seconds; and the wetting-agent treated pen-writing sizing degree thereof, which is measured by immersing the paper in a wetting liquid comprising a surfactant for 5 seconds and then drying said paper at 110° C., is in Rank 5 to 9.

This paper is useful as the paper for maps and measurement recording sheets, which require strict dimensional stability, with minimum moisture absorption, elongation and formation of wrinkles by moisture absorption.

It is preferable that this paper further have at least one of the following characteristics:

(1) The ratio of the wet tensile strength of the paper to the non-wet tensile strength of the paper in the machine direction thereof is 0.16 or more when the wet tensile strength thereof is determined after wetting the paper by immersing the paper in water at 20° C. for 1 minute, and the non-wet tensile strength thereof is determined prior to the wetting.

(2) The wetting-agent treated sizing degree of the paper is 0.3 s or more, which is measured by immersing the paper in a wetting liquid comprising a surfactant for 5 seconds and then drying the paper at 110° C.

(3) The stiffness thereof in the machine direction of the paper is 0.3 mN or more, which is measured by immersing the paper in water at 20° C. for 1 minute, in accordance with the Gurley method.

(4) The short-time wetting elongation percentage of the paper in the cross direction thereof is 1.0% or less, which is measured by bringing the paper into contact with a wetting liquid comprising a surfactant for 3 seconds.

Other features of this invention will become apparent in the course of the following description of exemplary embodiments, which are given for illustration of the invention and are not intended to be limiting thereof.

EXAMPLE 1

A copy paper sheet was prepared by internally adding 0.5 parts by weight of melamine-formaldehyde resin to 100 parts by weight of a broadleaf kraft pulp (LBKP) refined with a Canadian standard freeness of 450 ml.

The wet elongation percentage of this copy paper sheet in the cross direction thereof when immersed in water at 20° C. for 1 minute was 1.5 %.

On this copy paper sheet, toner images were formed by use of a commercially available plain paper copying machine ("IMAGIO 320 FPI" made by Ricoh Company, Ltd.).

The thus prepared toner-image-bearing copy paper sheet was immersed in an aqueous solution containing 0.5 wt. % of a nonionic surfactant (polyoxyethylene alkyl ether) (Trademark "BT-7" made by Nikko Chemicals Co., Ltd.). The Bristow penetration rate of the copy paper sheet was 18 ml/m$^2$ per a period of 0.4 seconds.

A heated rubber roller was brought into pressure contact with the toner-image-bearing copy paper sheet. The toner-image-bearing copy paper sheet was then peeled away from the heated rubber roller. The toner images formed on the recording paper sheet were completely transferred to the surface of the heated rubber roller, and a recycled recording paper sheet free from toner images and wrinkles on the surface thereof was obtained.

This recycled copy paper sheet was used again as a copy sheet in the above-mentioned copying machine. Clear images were obtained.

This recycling and copying process was repeated five times. Copy images with the same image quality as the initial image quality were obtained throughout the repeated recycling and copying processes.

EXAMPLE 2

A copy paper sheet was prepared by internally adding 0.4 parts by weight of polyaminoepichlorohydrin resin (Trademark "Epinox P-1301-A" made by Hercules Co., Ltd.) and 3 parts by weight of carboxymethyl cellulose to 100 parts by weight of a broadleaf kraft pulp (LBKP) refined with a Canadian standard freeness of 450 ml.

The wet elongation percentage of this copy paper sheet in the cross direction thereof when immersed in water at 20° C. for 1 minute was 1.7%.

On this copy paper sheet, toner images were formed by use of the same commercially available plain paper copying machine as employed in Example 1.

The thus prepared toner-image-bearing copy paper sheet was immersed in an aqueous solution containing 0.5 wt. % of a nonionic surfactant (polyoxyethylene alkyl ether) (Trademark "BT-7" made by Nikko Chemicals Co., Ltd.). The Bristow penetration rate of the copy paper sheet was 17 ml/m$^2$ per a period of 0.4 seconds.

A heated rubber roller was brought into pressure contact with the toner-image-bearing copy paper sheet. The toner-image-bearing copy paper sheet was then peeled away from the heated rubber roller. The toner images formed on the recording paper sheet were completely transferred to the surface of the heated rubber roller, and a recycled recording paper sheet free from toner images and wrinkles on the surface thereof was obtained.

This recycled copy paper sheet was used again as a copy sheet in the above-mentioned copying machine. Clear images were obtained.

This recycling and copying process was repeated five times. Copy images with the same image quality as the initial image quality were obtained throughout the repeated recycling and copying processes.

EXAMPLE 3

To 100 parts by weight of a broadleaf kraft pulp (LBKP) refined with a Canadian standard freeness of 400 ml, 0.5 parts by weight of an alkyl ketene dimer sizing agent (Trademark "AS202" made by Nippon Pneumatic Mfg. Co., Ltd.), 0.5 parts by weight of a polyamide-epichlorohydrin resin (Trademark "WS-570" made by Nippon Pneumatic Mfg. Co., Ltd.), 1 part by weight of a polyacrylamide resin (Trademark "POLYSTRON-117" made by ARAKAWA CHEMICAL INDUSTRIES, LTD.), and 3 parts by weight of potassium carbonate (Trademark "PCX-850" made by Shiraishi Kogyo Kaisha, Ltd.) were internally added.

Furthermore, by use of a size press apparatus of a Fourdrinier paper machine (Langsiebmaschine), 1 g/m$^2$ (corresponding to 1.3 parts by weight to 100 parts by weight of the above-mentioned LBKP) of oxidized starch (Trademark "MS#3800" made by Nihon Shokuhin Kako Co., Ltd.), 0.7 g/m$^2$ (corresponding to 1 part by weight to 100 parts by weight of the LBKP) of PVA (Trademark "PVA 117" made by Kuraray Co., Ltd.), 0.4 g/m$^2$ (corresponding to 0.5 parts by weight to 100 parts by weight of the LBKP) of a polyamideepichlorohydrin resin (Trademark "WS-525" made by Nippon Pneumatic Mfg. Co., Ltd.), and 0.9 g/m$^2$ (corresponding to 1.1 parts by weight to 100 parts by weight of the LBKP) of an alkyl ketene dimer sizing agent (Trademark "AS202" made by Nippon Pneumatic Mfg. Co., Ltd.) were applied for surface sizing, whereby a copy paper sheet with a basis weight of 74 g/m$^2$ was prepared.

The wet elongation percentage of this copy paper sheet in the cross direction thereof when immersed in water at 20° C. for I minute was 1.1%.

This copy paper sheet had Rank 7 with respect to the wetting-agent treated pen-writing sizing degree thereof.

The ratio of the wet tensile strength of this copy paper sheet to the non-wet tensile strength thereof in the machine direction thereof was 0.24.

The Bristow penetration rate of this copy paper sheet was 14 ml/m$^2$ per a period of 0.4 seconds.

The wetting-agent treated sizing degree of this copy paper was 1.8 s.

The wet stiffness of this copy paper in the machine direction thereof was 0.38 mN.

The short-time wet elongation percentage of this copy paper sheet in the cross direction thereof was 0.12%.

On this copy paper sheet, toner images were formed by use of the same commercially available plain paper copying machine as employed in Example 1.

The thus prepared toner-image-bearing copy paper sheet was immersed in a commercially available 0.8% aqueous solution of an anionic surfactant, sodium dihexylsulfosuccinate, (Trademark "MA-80" made by Mitsui Cytec, Ltd.) serving as image removal acceleration liquid.

A heated rubber roller was brought into pressure contact with the toner-image-bearing copy paper sheet. The toner-image-bearing copy paper sheet was then peeled away from the heated rubber roller. The toner images formed on the recording paper sheet were completely transferred to the surface of the heated rubber roller, and a recycled recording paper sheet free from toner images and wrinkles on the surface thereof was obtained.

This recycled copy paper sheet was used again as a copy sheet in the above-mentioned copying machine. Clear images were obtained.

This recycling and copying process was repeated five times. Copy images with the same image quality as the initial image quality were obtained with excellent image releasability throughout the repeated recycling and copying processes without the formation of the previously mentioned "machine-direction passing wrinkles" and "recopying wrinkles" and the occurrence of jamming of the copy paper sheet in the copying machine.

No ink spreading was observed when written on the recycled copy paper sheet by use of a pen using an aqueous ink.

EXAMPLE 4

To 100 parts by weight of the same pulp (LBKP) as employed in Example 3, 0.1 parts by weight of a polyamideepichlorohydrin resin (Trademark "WS-570" made by Nippon Pneumatic Mfg. Co., Ltd.) and 3 parts by weight of potassium carbonate (Trademark "PCX-850" made by Shiraishi Kogyo Kaisha, Ltd.) were internally added.

Furthermore, by use of a size press apparatus of a Fourdrinier paper machine (Langsiebmaschine), 1.1 g/m$^2$ (corresponding 1.5 parts by weight to 100 parts by weight of the above-mentioned LBKP) of oxidized starch (Trademark "MS#3800" made by Nihon Shokuhin Kako Co., Ltd.), 1.1 g/m$^2$ (corresponding to 1.5 part by weight to 100 parts by weight of the LBKP) of PVA (Trademark "PVA 117" made by Kuraray Co., Ltd.), 0.2 g/m$^2$ (corresponding to 0.3 parts by weight to 100 parts by weight of the LBKP) of a polyamideepichlorohydrin resin (Trademark "WS-525" made by Nippon Pneumatic Mfg. Co., Ltd.), and 0.3 g/m$^2$ (corresponding to 0.4 parts by weight to 100 parts by weight of the LBKP) of an alkyl ketene dimer sizing agent (Trademark "AS202" made by Nippon Pneumatic Mfg. Co., Ltd.) were applied for surface sizing, whereby a copy paper sheet with a basis weight of 74 g/m$^2$ was prepared.

The wet elongation percentage of this copy paper sheet in the cross direction thereof when immersed in water at 20° C. for 1 minute was 1.7%.

This copy paper sheet had Rank 5 with respect to the wetting-agent treated pen-writing sizing degree thereof.

The ratio of the wet tensile strength of this copy paper sheet to the non-wet tensile strength thereof in the machine direction thereof was 0.16.

The Bristow penetration rate of this copy paper sheet was 50 ml/m$^2$ per a period of 0.4 seconds.

The wetting-agent treated sizing degree of this copy paper was 0.5 s.

The wet stiffness of this copy paper in the machine direction thereof was 0.33 mN.

The short-time wet elongation percentage of this copy paper sheet in the cross direction thereof was 0.75%.

The same recycling and copying process as in Example 1 was conducted in the same manner as in Example 1 by use of this copy paper sheet by repeating the recycling and copying process five times.

The result was that images with the same image quality as the initial image quality were obtained with excellent image releasability throughout the repeated recycling and copying processes without the formation of the previously mentioned "machine-direction passing wrinkles" and "re-copying wrinkles" and the occurrence of jamming of the copy paper sheet in the copying machine. No ink spreading was observed when written on the recycled copy paper sheet by use of a pen using an aqueous ink.

EXAMPLE 5

To 100 parts by weight of the same broadleaf kraft pulp (LBKP) as employed in Example 3, 1.8 parts by weight of a commercially available sizing agent (Trademark "SIZE PINE E" made by ARAKAWA CHEMICAL INDUSTRIES, LTD.), 2.5 parts by weight of aluminum sulfate, 3 parts by weight of talc (Trademark "Talc SF" made by Asada Milling Co., Ltd.), and 1 part by weight of a polyacrylamide resin (Trademark "POLYSTRON-117" made by ARAKAWA CHEMICAL INDUSTRIES, LTD.) were internally added.

Furthermore, by use of a size press apparatus of a Fourdrinier paper machine (Langsiebmaschine), 1.0 g/m$^2$ (corresponding 1.3 parts by weight to 100 parts by weight of the above-mentioned LBKP) of oxidized starch (Trademark "MS#3800" made by Nihon Shokuhin Kako Co., Ltd.), 0.7 g/m$^2$ (corresponding to 1.0 part by weight to 100 parts by weight of the LBKP) of PVA (Trademark "PVA 117" made by Kuraray Co., Ltd.), 0.4 g/m$^2$ (corresponding to 0.5 parts by weight to 100 parts by weight of the LBKP) of glyoxal (made by The Nippon Synthetic Chemical Industry Co., Ltd.) and 0.9 g/m$^2$ (corresponding to 1.1 parts by weight to 100 parts by weight of the LBKP) of a styrene-based synthetic sizing agent (Trademark "POLYMARON 360" made by ARAKAWA CHEMICAL INDUSTRIES, LTD.) were applied for surface sizing, whereby a copy paper sheet with a basis weight of 74 g/m$^2$ was prepared.

The wet elongation percentage of this copy paper sheet in the cross direction thereof when immersed in water at 20° C. for 1 minute was 1.3%.

This copy paper sheet had Rank 5 with respect to the wetting-agent treated pen-writing sizing degree thereof.

The ratio of the wet tensile strength of this copy paper sheet to the non-wet tensile strength thereof in the machine direction thereof was 0.18.

The Bristow penetration rate of this copy paper sheet was 45 ml/m$^2$ per a period of 0.4 seconds.

The wetting-agent treated sizing degree of this copy paper was 0.3 s.

The wet stiffness of this copy paper in the machine direction thereof was 0.41 mN.

The short-time wet elongation percentage of this copy paper sheet in the cross direction thereof was 0.44%.

The same recycling and copying process as in Example 1 was conducted in the same manner as in Example 1 by use of this copy paper sheet by repeating the recycling and copying process five times.

The result was that images were obtained without the formation of the previously mentioned "machine-direction passing wrinkles" and "re-copying wrinkles" and the occurrence of jamming of the copy paper sheet in the copying machine throughout the repeated recycling and copying processes. No ink spreading was observed when written on the recycled copy paper sheet by use of a pen using an aqueous ink.

EXAMPLE 6

To 100 parts by weight of the same broadleaf kraft pulp (LBKP) as employed in Example 3, 1.8 parts by weight of a commercially available sizing agent (Trademark "SIZE PINE E" made by ARAKAWA CHEMICAL INDUSTRIES, LTD.), 2.5 parts by weight of aluminum sulfate, 3 parts by weight of talc (Trademark "Talc SF" made by Asada Milling Co., Ltd.), 1 part by weight of a polyacrylamide resin (Trademark "POLYSTRON-117" made by ARAKAWA CHEMICAL INDUSTRIES, LTD.) and 0.5 parts by weight of a melamineformalin resin (Trademark "Sumirez Resin AC" made by Sumitomo Chemical Co., Ltd.) were internally added.

Furthermore, by use of a size press apparatus of a Fourdrinier paper machine (Langsiebmaschine), 1.0 g/m$^2$ (corresponding 1.3 parts by weight to 100 parts by weight of the above-mentioned LBKP) of oxidized starch (Trademark "MS#3800" made by Nihon Shokuhin Kako Co., Ltd.), 0.7 g/m$^2$ (corresponding to 1.0 part by weight to 100 parts by weight of the LBKP) of PVA (Trademark "PVA 117" made by Kuraray Co., Ltd.), 0.2 g/m$^2$ (corresponding to 0.3 parts by weight to 100 parts by weight of the LBKP) of a melamineformalin resin (Trademark "Sumirez Resin 613" made by Sumitomo Chemical Co., Ltd.) and 0.9 g/m$^2$ (corresponding to 1.1 parts by weight to 100 parts by weight of the LBKP) of a styrene-based synthetic sizing agent (Trademark "POLYMARON 360" made by ARAKAWA CHEMICAL INDUSTRIES, LTD.) were applied for surface sizing, whereby an A4 size recording paper sheet with a basis weight of 74 g/m$^2$ was prepared.

The wet elongation percentage of this copy paper sheet in the cross direction thereof when immersed in water at 20° C. for 1 minute was 1.1%.

This copy paper sheet had Rank 5 with respect to the wetting-agent treated pen-writing sizing degree thereof.

The ratio of the wet tensile strength of this copy paper sheet to the non-wet tensile strength thereof in the machine direction thereof was 0.20.

The Bristow penetration rate of this copy paper sheet was 46 ml/m$^2$ per a period of 0.4 seconds.

The wetting-agent treated sizing degree of this copy paper was 0.3 s.

The wet stiffness of this copy paper in the machine direction thereof was 0.44 mN.

The short-time wet elongation percentage of this copy paper sheet in the cross direction thereof was 0.14%.

The same recycling and copying process as in Example 1 was conducted in the same manner as in Example 1 by use of this copy paper sheet by repeating the recycling and copying process five times.

The result was that images were obtained without the formation of the previously mentioned "machine-direction passing wrinkles" and "re-copying wrinkles" and the occurrence of jamming of the copy paper sheet in the copying machine throughout the repeated recycling and copying processes. No ink spreading was observed when written on the recycled copy paper sheet by use of a pen using an aqueous ink.

Comparative Example 1

The elongation percentage of a commercially available copy paper (Trademark "RICOPY PPC PAPER TYPE 6200" made by Ricoh Company, Ltd.) in the cross direction thereof when immersed in water at 20° C. for 1 minute was 3.3%.

This copy paper had Rank 3 with respect to the wetting-agent treated pen-writing sizing degree thereof.

The ratio of the wet tensile strength of this copy paper to the non-wet tensile strength thereof in the machine direction thereof was 0.09.

The Bristow penetration rate of this copy paper was 82 ml/m$^2$ per a period of 0.4 seconds.

The wetting-agent treated sizing degree of this copy paper was 0 s.

The wet stiffness of this copy paper in the machine direction thereof was 0.28 mN.

The short-time wet elongation percentage of this copy paper in the cross direction thereof was 3.61%.

The same recycling and copying process as in Example 1 was conducted in the same manner as in Example 1 by use of this copy paper by repeating the recycling and copying process five times.

The result was that many "machine-direction passing wrinkles" were formed during the course of machine-direction recycling process, so that it was impossible to recycle this copy paper for use in the present invention. When the copy paper was subjected to cross-direction recycling process, no wrinkles were formed, but due to the formation of "re-copying wrinkles", it was impossible to use this copy paper for copying after it was recycled. Jamming of the copy paper took place with a 1% occurrence ratio.

Comparative Example 2

To 100 parts by weight of the same broadleaf kraft pulp (LBKP) as employed in Example 3, 0.1 parts by weight of a polyamideepichlorohydrin resin (Trademark "WS-570" made by Nippon Pneumatic Mfg. Co., Ltd.) and 3 parts by weight of potassium carbonate (Trademark "PCX-850" made by Shiraishi Kogyo Kaisha, Ltd.) were internally added.

Furthermore, by use of a size press apparatus of a Fourdrinier paper machine (Langsiebmaschine), 0.7 g/m$^2$ (corresponding 1.0 part by weight to 100 parts by weight of the above-mentioned LBKP) of oxidized starch (Trademark "MS#3800" made by Nihon Shokuhin Kako Co., Ltd.), 0.7 g/m$^2$ (corresponding to 1.0 part by weight to 100 parts by weight of the LBKP) of PVA (Trademark "PVA 117" made by Kuraray Co., Ltd.), 0.15 g/m$^2$ (corresponding to 0.2 parts by weight to 100 parts by weight of the LBKP) of a polyamideepichlorohydrin resin (Trademark "WS-525" made by Nippon Pneumatic Mfg. Co., Ltd.), and 0.2 g/m$^2$ (corresponding to 0.3 parts by weight to 100 parts by weight of the LBKP) of an alkyl ketene dimer sizing agent (Trademark "AS202" made by Nippon Pneumatic Mfg. Co., Ltd.) were applied for surface sizing, whereby a copy paper sheet with a basis weight of 74 g/m$^2$ was prepared.

The wet elongation percentage of this copy paper sheet in the cross direction thereof when immersed in water at 20° C. for 1 minute was 2.1%.

This copy paper sheet had Rank 5 with respect to the wetting-agent treated pen-writing sizing degree thereof.

The ratio of the wet tensile strength of this copy paper sheet to the non-wet tensile strength thereof in the machine direction thereof was 0.13.

The Bristow penetration rate of this copy paper sheet was sheet was 68 ml/m$^2$ per a period of 0.4 seconds.

The wetting-agent treated sizing degree of this copy paper sheet was 0.1 s.

The wet stiffness of this copy paper sheet in the machine direction thereof was 0.32 mN.

The short-time wet elongation percentage of this copy paper sheet in the cross direction thereof was 1.23%.

The same recycling and copying process as in Example 1 was conducted in the same manner as in Example 1 by use of this copy paper by repeating the recycling and copying process five times.

The result was that "machine-direction passing wrinkles" were formed during the course of the third machine-direction recycling process, so that it was impossible to recycle this copy paper. When a recycled copy paper sheet without wrinkles was used in copying, wrinkles were often formed in the recycled copy paper sheet. Jamming of the copy paper did not take place during the above recycling and copying processes.

Comparative Example 3

To 100 parts by weight of the same broadleaf kraft pulp (LBKP) employed in Example 3, 0.35 parts by weight of an alkyl ketene dimer sizing agent (Trademark "AS202" made by Nippon Pneumatic Mfg. Co., Ltd.), 0.35 parts by weight of a polyamideepichlorohydrin resin (Trademark "WS-570" made by Nippon Pneumatic Mfg. Co., Ltd.), 3 parts by weight of potassium carbonate (Trademark "PCX-850" made by Shiraishi Kogyo Kaisha, Ltd.), 1 part by weight of a polyacrylamide resin (Trademark "POLYSTRON-117" made by ARAKAWA CHEMICAL INDUSTRIES, LTD.), and 1.5 parts by weight of a cationic starch (Trademark "High Max NC 10" made by Kyoritsu Yukikogyo Co., Ltd.) were internally added, whereby a copy paper sheet was prepared.

The wet elongation percentage of this copy paper sheet in the cross direction thereof when immersed in water at 20° C. for 1 minute was 2.3%.

This copy paper sheet had Rank 5 with respect to the wetting-agent treated pen-writing sizing degree thereof.

The ratio of the wet tensile strength of this copy paper sheet to the non-wet tensile strength thereof in the machine direction thereof was 0.15.

The Bristow penetration rate of this copy paper sheet was 63 ml/m$^2$ per a period of 0.4 seconds.

The wetting-agent treated sizing degree of this copy paper sheet was 0.1 s.

The wet stiffness of this copy paper sheet in the machine direction thereof was 0.32 mN.

The short-time wet elongation percentage of this copy paper sheet in the cross direction thereof was 1.28%.

The same recycling and copying process as in Example 1 was conducted in the same manner as in Example 1 by use of this copy paper by repeating the recycling and copying process five times.

The result was that the formation of "machine-direction passing wrinkles" during the course of the machine-direction recycling process, and "re-copying wrinkles" in the copying machine was almost the same as in Comparative Example 2, but less than those in Comparative Example 1. However, this copy paper sheet was not suitable for recycling. Jamming of the copy paper did not take place during the above recycling and copying processes.

As explained in the above, in the present invention, the image-bearing-recording material is wetted with the water-containing image removal acceleration liquid, and the image releasing member is brought into contact with the images formed on the recording material under application of heat and/or pressure, whereby only the images are peeled away from the recording material, so that the recording material from which the images are removed can be used as a recording material for copying as it is.

Generally, when a recording material comprising paper which comprises as the main component cellulose fibers is wetted with water, the stiffness of the recording material is decreased. When the recording material bears hydrophobic images thereon, the adhesion between the hydrophobic images and the cellulose fibers is significantly decreased when the recording material is wetted as mentioned above.

In other words, in the recording material comprising paper which comprises as the main component cellulose fibers, the intertwinement of the cellulose fibers forms countless fine concave and convex portions on the surface of the recording material and countless fine voids inside the recording material.

When hydrophobic toner images are formed on the surface of the recording material in the above-mentioned state and fixed thereto by a plain paper copier, the fixed toner images are larger than the concave and convex portions on the surface of the recording material, so that there are a number of voids between the toner images and the surface of the recording material in the toner image fixed portions.

When the water-containing image removal acceleration liquid is applied or sprayed to the hydrophobic-image-bearing recording material, or the hydrophobic-image-bearing recording material is immersed into the water-containing image removal acceleration liquid, the liquid penetrates into the cellulose fibers and the voids between the cellulose fibers, and reaches the contact portions between the cellulose fibers and the hydrophobic images by capillarity.

As a result, the adhesion between the hydrophobic images and the cellulose fibers is significantly decreased. Furthermore, when the above liquid penetrates into the cellulose fibers, the cellulose fibers swell and are deformed, so that the space between the cellulose fibers and the hydrophobic images is increased, or the contact areas between the two are significantly decreased. The result is that the adhesion between the hydrophobic images and the cellulose fibers is significantly decreased.

According to the present invention, when the image-bearing-recording material is wetted with the water-containing image removal acceleration liquid, and the image releasing member is brought into contact with the images formed on the recording material under application of heat and/or pressure, only the images can be easily peeled away from the recording material without damaging the surface of the recording material, and the image-removed recording material can be used as a new recording material repeatedly.

What is claimed is:

1. A recording material of improved dimensional stability comprising paper which comprises cellulose fibers, wherein the elongation percentage of said paper in the cross direction thereof when immersed in water at 20° C. for 1 minute is 1.8% or less, wherein said paper has Rank 5 to 9 with respect to the wetting-agent treated pen-writing sizing degree thereof, which is measured by immersing said paper in a wetting liquid comprising a surfactant for 5 seconds and then drying said paper at 110° C., the wet stiffness thereof in the machine direction thereof is 0.3 mN or more, which is measured by immersing said paper in water at 20° C. for 1 minute, in accordance with the Gurley method, the ratio of the wet tensile strength thereof to the non-wet tensile strength thereof in the machine direction thereof is in the range of 0.16 to 0.4, and wherein said paper further comprises an effective amount of a single or combined component selected from the group consisting of (a) a water-proofing agent, (b) a water-proofing agent and a water-soluble polymer, and (c) a water-proofing agent and a sizing agent, which forms a protection structure for binding said cellulose fibers.

2. The recording material as claimed in claim 1, wherein said paper has at least one characteristic selected from the group consisting of (1) the characteristic that the ratio of the wet tensile strength thereof to the non-wet tensile strength thereof in the machine direction thereof is 0.16 or more, said wet tensile strength thereof being determined after wetting said paper by immersing said paper in water at 20° C. for 1 minute, and said non-wet tensile strength thereof being determined prior to said wetting; (2) the characteristic that the Bristow penetration rate thereof is in the range of 12 to 60 ml/m$^2$ per a period of 0.4 seconds, which is measured by wetting said paper with a wetting liquid comprising a surfactant for 0.4 seconds; (3) the characteristic that the wetting-agent treated sizing degree thereof is 0.3 s or more, which is measured by immersing said paper in a wetting liquid comprising a surfactant for 5 seconds and then drying said paper at 110° C.; and (4) the short-time wetting elongation percentage thereof in the cross direction thereof is 1.0% or less, which is measured by bringing said paper into contact with a wetting liquid comprising a surfactant for 3 seconds.

3. The recording material as claimed in claim 2, wherein the ratio of the wet tensile strength thereof to the non-wet tensile strength thereof in the machine direction thereof is in the range of 0.16 to 0.4, and the wetting-agent treated pen-writing sizing degree thereof is in the range of 0.3 s to 3 s.

4. The recording material as claimed in claim 2, wherein said paper has all of said characteristics (1) to (5) at the same time.

5. The recording material as claimed in claim 4, wherein the wetting-agent treated pen-writing sizing degree thereof is in the range of 0.3 s to 3 s.

6. The recording material as claimed in claim 1, wherein said water-proofing agent is in an amount of 0.3 wt. % or more, said water-soluble polymer is in an amount of 2 wt. % or more, and said sizing agent is in an amount of 0.3 wt. % or more with respect to the entire weight of said paper.

7. The recording material as claimed in claim 1, wherein said paper comprises said water-proofing agent in an amount of 0.5 to 1 wt. % and said water-soluble polymer in an amount of 2 to 5 wt. % in combination with respect to the entire weight of said paper, or said water-proofing agent in an amount of 0.5 to 1 wt. % and said sizing agent in an amount of 0.5 to 1.2 wt. % in combination with respect to the entire weight of said paper.

8. The recording material as claimed in claim 1, wherein said paper further comprises a water-proofing agent, a water-soluble polymer and a sizing agent, which form a protection structure for binding said cellulose fibers.

9. The recording material as claimed in claim 8, wherein said water-proofing agent is in an amount of 0.3 wt. % or more, said water-soluble polymer is in an amount of 2 wt. % or more, and said sizing agent is in an amount of 0.3 wt. % or more with respect to the entire weight of said paper.

10. The recording material as claimed in claim 9, wherein said water-proofing agent is in an amount of 0.5 to 1.0 wt. %, said water-soluble polymer is in an amount of 2 to 5 wt. %, and said sizing agent is in an amount of 0.5 to 1.2 wt. % with respect to the entire weight of said paper.

11. The recording material as claimed in claim 1, wherein said water-proofing agent is selected from the group consisting of polyamide epichlorohydrin resin, glyoxal and melamine-formaldehyde resin.

12. The recording material as claimed in claim 8, wherein said water-proofing agent is selected from the group consisting of polyamideepichlorohydrin resin, glyoxal and melamine-formaldehyde resin.

13. The recording material as claimed in claim 1, wherein said water-soluble polymer is selected from the group consisting of polyvinyl alcohol, starch and polyacrylamide resin.

14. The recording material as claimed in claim 8, wherein said water-soluble polymer is selected from the group consisting of polyvinyl alcohol, starch and polyacrylamide resin.

15. The recording material as claimed in claim 1, wherein said sizing agent comprising a sizing agent component having a contact angle ($\cos\theta$) in a range of −0.6 to 0.9 when a liquid with a surface tension of 40 mN/m is placed dropwise on a film prepared by drying said sizing agent component.

16. The recording material as claimed in claim 8, wherein said sizing agent comprising a sizing agent component having a contact angle ($\cos\theta$) in a range of −0.6 to 0.9 when a liquid with a surface tension of 40 mN/m is placed dropwise on a film prepared by drying said sizing agent component.

17. The recording material as claimed in claim 1, wherein said paper has Rank 5 to 9 with respect to the wetting-agent treated pen-writing sizing degree thereof, which is measured by immersing said paper in a wetting liquid comprising a surfactant for 5 seconds and then drying said paper at 110° C.

18. The recording material as claimed in claim 1, wherein said paper has at least one characteristic selected from the group consisting of (1) the characteristic that the ratio of the wet tensile strength thereof to the non-wet tensile strength thereof in the machine direction thereof is 0.16 or more, said wet tensile strength thereof being determined after wetting said paper by immersing said paper in water at 20° C. for 1 minute, and said non-wet tensile strength thereof being determined prior to said wetting; (2) the characteristic that the Bristow penetration rate thereof is in the range of 12 to 60 ml/m$^2$ per a period of 0.4 seconds, which is measured by wetting said paper with a wetting liquid comprising a surfactant for 0.4 seconds; (3) the characteristic that the wetting-agent treated sizing degree thereof is 0.3 s or more, which is measured by immersing said paper in a wetting liquid comprising a surfactant for 5 seconds and then drying said paper at 110° C.; (4) the wet stiffness thereof in the machine direction thereof is 0.3 mN or more, which is measured by immersing said paper in water at 20° C. for 1 minute, in accordance with the Gurley method; and (5) the short-time wetting elongation percentage thereof in the cross direction thereof is 1.0% or less, which is measured by bringing said paper into contact with a wetting liquid comprising a surfactant for 3 seconds.

19. The recording material as claimed in claim 18, wherein the ratio of the wet tensile strength thereof to the non-wet tensile strength thereof in the machine direction thereof is in the range of 0.16 to 0.4, and the wetting-agent treated pen-writing sizing degree thereof is in the range of 0.3 s to 3 s.

20. The recording material as claimed in claim 18, wherein said paper has all of said characteristics (1) to (5) at the same time.

21. The recording material as claimed in claim 20, wherein the ratio of the wet tensile strength thereof to the non-wet tensile strength thereof in the machine direction thereof is in the range of 0.16 to 0.4, and the wetting-agent treated pen-writing sizing degree thereof is in the range of 0.3 s to 3 s.

22. The recording material as claimed in claim 8, wherein said paper has Rank 5 to 9 with respect to the wetting-agent treated pen-writing sizing degree thereof, which is measured by immersing said paper in a wetting liquid comprising a surfactant for 5 seconds and then drying said paper at 110° C.

23. The recording material as claimed in claim 8, wherein said paper has at least one characteristic selected from the group consisting of (1) the characteristic that the ratio of the wet tensile strength thereof to the non-wet tensile strength thereof in the machine direction thereof is 0.16 or more, said wet tensile strength thereof being determined after wetting said paper by immersing said paper in water at 20° C. for 1 minute, and said non-wet tensile strength thereof being determined prior to said wetting; (2) the characteristic that the Bristow penetration rate thereof is in the range of 12 to 60 ml/m$^2$ per a period of 0.4 seconds, which is measured by wetting said paper with a wetting liquid comprising a surfactant for 0.4 seconds; (3) the characteristic that the wetting-agent treated sizing degree thereof is 0.3 s or more, which is measured by immersing said paper in a wetting liquid comprising a surfactant for 5 seconds and then drying said paper at 110° C.; (4) the wet stiffness thereof in the machine direction thereof is 0.3 mN or more, which is measured by immersing said paper in water at 20° C. for 1 minute, in accordance with the Gurley method; and (5) the short-time wetting elongation percentage thereof in the cross direction thereof is 1.0% or less, which is measured by bringing said paper into contact with a wetting liquid comprising a surfactant for 3 seconds.

24. The recording material as claimed in claim 21, wherein the ratio of the wet tensile strength thereof to the non-wet tensile strength thereof in the machine direction thereof is in the range of 0.16 to 0.4, and the wetting-agent treated pen-writing sizing degree thereof is in the range of 0.3 s to 3 s.

25. The recording material as claimed in claim 21, wherein said paper has all of said characteristics (1) to (5) at the same time.

26. The recording material as claimed in claim 23, wherein the ratio of the wet tensile strength thereof to the non-wet tensile strength thereof in the machine direction thereof is in the range of 0.16 to 0.4, and the wetting-agent treated pen-writing sizing degree thereof is in the range of 0.3 s to 3 s.

27. A method of producing a recording material according to claim 1 comprising paper which comprises cellulose fibers and a single or combined component selected from the group consisting of (a) a water-proofing agent, (b) a water-proofing agent and a water-soluble polymer, and (c) a water-proofing agent and a sizing agent, which forms a protection structure for binding said cellulose fibers, with the elongation percentage of said paper in the cross direction thereof when immersed in water at 20° C. for 1 minute being 1.8% or less, by use of a pulp which comprises a water-proofing agent in an amount of 0.4 wt. % or more, and a water-soluble polymer in amount of 3 wt. % or more or a sizing agent in an amount of 0.4 wt. % or more, with respect to the entire weight of said pulp.

28. The method as claimed in claim 27, wherein said water-proofing agent is in an amount of 0.6 to 1.2 wt. %, said water-soluble polymer is in an amount of 3 to 6 wt. % or said sizing agent is in an amount of 0.6 to 1.6 wt. % with respect to the entire weight of said pulp.

29. A method of producing a recording material according to claim 1 comprising paper which comprises cellulose fibers and a water-proofing agent, a water-soluble polymer and a sizing agent, which form a protection structure for binding said cellulose fibers, with the elongation percentage of said paper in the cross direction thereof when immersed in water at 20° C. for 1 minute being 1.8% or less, by use of a pulp comprising a water-proofing agent in an amount of 0.4 wt. % or more, a water-soluble polymer in an amount of 3 wt. % or more, and a sizing agent in an amount of 0.4 wt. % or more with respect to the entire weight of said pulp.

30. The method as claimed in claim 29, wherein said water-proofing agent is in an amount of 0.6 to 1.2 wt. %, said water-soluble polymer is in an amount of 3 to 6 wt. %, and said sizing agent is in an amount of 0.6 to 1.6 wt. % with respect to the entire weight of said pulp.

31. The method as claimed in claim 27, wherein at least part of said water-proofing agent, said water-soluble polymer and said sizing agent is used for subjecting said recording material to surface sizing treatment.

32. The method as claimed in claim 29, wherein at least part of said water-proofing agent, said water-soluble polymer and said sizing agent is used for subjecting said recording material to surface sizing treatment.

33. A paper which comprises cellulose fibers, wherein the elongation percentage of said paper in the cross direction thereof when immersed in water at 20° C. for 1 minute is 1.8% or less, wherein said paper has Rank 5 to 9 with respect to the wetting-agent treated pen-writing sizing degree thereof, which is measured by immersing said paper in a wetting liquid comprising a surfactant for 5 seconds and then drying said paper at 110° C., the wet stiffness thereof in the machine direction thereof is 0.3 mN or more, which is measured by immersing said paper in water at 20° C. for 1 minute, in accordance with the Gurley method, the ratio of the wet tensile strength thereof to the non-wet tensile strength thereof in the machine direction thereof is in the range of 0.16 to 0.4, and wherein said paper further comprises an effective mount of a single or combined component selected from the group consisting of (a) a water-proofing agent, (b) a water-proofing agent and a water-soluble polymer, and (c) a water-proofing agent and a sizing agent, which forms a protection structure for binding said cellulose fibers.

* * * * *

UNITED STATES PATENT AND TRADEMARK OFFICE

CERTIFICATE OF CORRECTION

PATENT NO. : 5,738,759
DATED : APRIL 14, 1998
INVENTOR(S) : HIROSHI KITAZAWA, ET AL.

It is certified that error appears in the above-identified patent and that said Letters Patent is hereby corrected as shown below:

Column 8, line 48 "excessive water the surface" should read --excessive water from the surface--.

Column 24, line 36 "mount" should read --amount--.

Signed and Sealed this

Second Day of February, 1999

*Attest:*

*Attesting Officer*

*Acting Commissioner of Patents and Trademarks*